United States Patent [19]

Parker et al.

[11] Patent Number: 4,471,606

[45] Date of Patent: Sep. 18, 1984

[54] APPARATUS FOR FORMING A COMPOSITE YARN BY FRICTION SPINNING

[75] Inventors: Alan Parker, Bolton; Peter J. Dickinson, Rossendale, both of England

[73] Assignee: Hollingsworth (U.K.) Limited, United Kingdom

[21] Appl. No.: 493,388

[22] Filed: May 10, 1983

[30] Foreign Application Priority Data

May 21, 1982 [GB] United Kingdom ..... 8214800

[51] Int. Cl.[3] ..... D01H 1/12; D02G 3/36; D02G 3/38

[52] U.S. Cl. ..... 57/5; 57/401

[58] Field of Search ..... 57/5, 6, 400, 352, 401, 57/334, 335

[56] References Cited

U.S. PATENT DOCUMENTS

| | | | |
|---|---|---|---|
| 4,315,398 | 2/1982 | Parker et al. | 57/401 |
| 4,362,008 | 12/1982 | Parker et al. | 57/5 |
| 4,380,892 | 4/1983 | Parker et al. | 57/401 |
| 4,392,343 | 7/1983 | Parker et al. | 57/401 |
| 4,404,792 | 9/1983 | Parker et al. | 57/401 |

*Primary Examiner*—John Petrakes

*Attorney, Agent, or Firm*—Donald H. Feldman

[57] ABSTRACT

Friction spinning apparatus for producing a composite yarn has a groove or recess formed in at least one of the friction spinning rollers, to receive a strand guide tube which can then guide a core strand directly to the yarn formation line substantially at the nip between the rollers.

9 Claims, 3 Drawing Figures

APPARATUS FOR FORMING A COMPOSITE YARN BY FRICTION SPINNING

FIELD OF THE INVENTION

This invention relates to an apparatus for forming a yarn including a component of staple fibres and a component formed by a continuous strand.

PRIOR ART

In published European Application No. 31250 there is disclosed an apparatus and method for spinning a yarn of the above type. In this apparatus there is provided a pair of rollers arranged such that a surface of each of the rollers cooperates with a surface of the other to form an elongate yarn formation zone at a line of closest approach of the surfaces, means for feeding the staple fibres to the elongate zone, means for guiding the continuous strand to the elongate zone and means for rotating the surfaces about respective axes to twist the fibres and the strand to form a yarn.

The guide means in the above disclosure comprises a small bore tube arranged to extend toward the line of closest approach from the side opposite the fibre feed means. The tube is chamfered to allow closest possible approach and is curved to direct the strand to approach the yarn axis substantially parallel thereto. The spacing between the rollers in a typical example is of the order of 0.15 mm and hence the geometry of the system severely limits the close approach of the tube to the yarn formation line.

This new technique for forming a composite yarn provides a yarn of totally new structure. However, the apparatus proposed to date has the disadvantage that, because the strand leaves the guiding tube some distance from the yarn formation line, ballooning and instability of the strand can occur whereby the exact axial location at which it joins with the staple fibres being deposited on the yarn formation line can vary in a transient manner. As explained in the above European Patent Publication 31250, this change in the axial location of the joining point will produce a change in the structure of the yarn, with more or less fibres joining the outer sheath of staple fibres. It will be appreciated that consistency of structure along the length of the yarn is essential for consistent performance in subsequent processes or end uses.

OBJECT OF THE INVENTION

It is an object of this invention to provide an apparatus of the above type wherein the axial location of the joining point of the strand with staple fibres is more accurately controlled.

SUMMARY OF THE INVENTION

Accordingly, the present invention provides apparatus for forming a yarn including a component of staple fibres and a component formed by a continuous strand comprising, a pair of rollers arranged such that the surface of each of the rollers cooperates with a surface of the other to form an elongate yarn formation zone at a line of closest approach of the surfaces, means for feeding the staple fibres to the elongate yarn formation zone, means for guiding the continuous strand to the elongate yarn formation zone and means for rotating each of the surfaces about a respective axis to twist the fibres and strand to form a yarn, wherein at least one of the surfaces includes a peripheral recess lying in a plane which is radial to the axis of rotation of the surface for receiving the strand guide means.

BRIEF DESCRIPTION OF THE DRAWINGS

The invention will now be described in more detail in conjunction with the accompanying drawings in which.

The apparatus is of the general type substantially as disclosed in published British Patent Application No. 2042599A and reference is made to that document for detailed disclosure of the principles involved. In addition, the apparatus employs the technique disclosed in the above-mentioned European Patent Publication No. 31250.

DESCRIPTION OF THE PREFERRED EMBODIMENT

For simplicity, description will be made here only of the modifications made to the apparatus according to the present invention.

Figure 1:
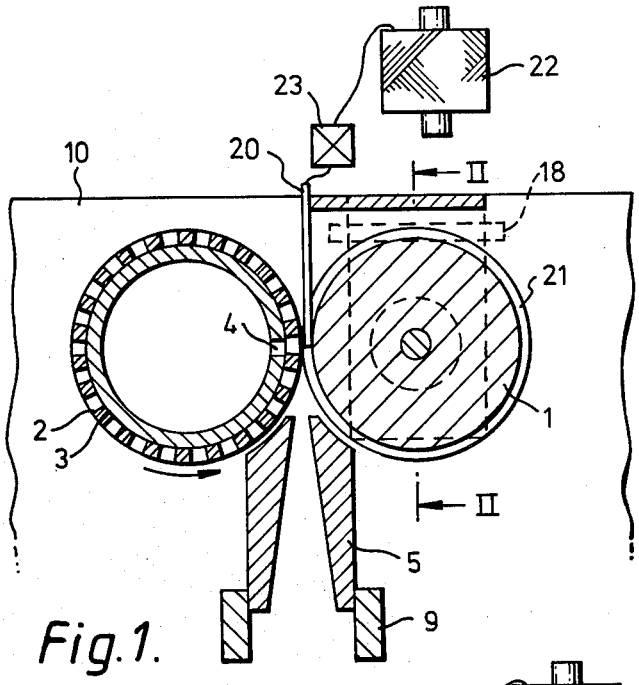
FIG. 1 is a cross-sectional view, taken along the line I—I of FIG. 2, of an apparatus according to the present invention.

The apparatus comprises an imperforate roller 1 and a perforated roller 2, the latter having an inner duct member 3, defining a slot 4 through which air is drawn to develop the necessary air stream to entrain fibres through a fibre feed duct 5. Fibres are fed into the fibre feed duct as an airborne supply, by means of fibre feed apparatus the outlet passage 9 of which is shown in FIG. 1. The fibre feed apparatus is generally of the type shown in FIG. 5 of published British Patent Application No. 2042599A and comprises a beater 10 operating with a feed roller and a feed pedal.

The roller 1 is mounted upon a shaft 11 driven by a belt and pulley arrangement 16, 17 and carried in bearings 12, 13. The bearings are in turn mounted in a cradle 7, comprising uprights 14, 15 and a cross-member 8. The cradle 7 is supported by a front frame member 19 and a rear frame member 10 in such a way that the upright 15 is pivoted on a pivot pin 18 on the member 10, whereby the upright 14 can be raised and lowered from its defined position on the frame member 19. This movement is provided to facilitate cleaning as disclosed in European Patent Publication No. 52412.

A fine guide tube 20 of ceramic material, typically 0.75 mm internal diameter, for a continuous strand delivered by a tensioning device 23 from a supply package 22, is carried by the cross-member 8 and extends toward the line of closest approach of the two rollers 1,2 at right-angles thereto. A peripheral recess 21 is provided in the roller 1 of such a depth and width that it just receives the yarn guide tube 20 to allow it to extend as far as the line of closest approach without touching either of the rollers. In contrast to the yarn guide tube disclosed in European Patent Publication No. 31250, the tube 20 is straight and extends toward the line of closest approach and terminates in a direction at right angles to the line. The depth and width of the peripheral recess or groove 21 in the surface of the roller 1 may both be 1.5 mm so as to readily receive a tube of 1 mm outside diameter. Such a tube is of sufficient size to receive a continuous filament strand of up to 150 Dtex although, of course, the dimensions of the parts may be increased or decreased, according to requirements.

The groove may however have an axial dimension greater than its radial dimension to allow the tube 20 to be repositioned axially of the rollers 1,2. Alternatively this same facility may be provided by having the roller 1 replaceable by another in which the groove 21 may have a width just sufficient to accommodate the tube 20 but the groove may be at a different location along the roller.

Figure 3:
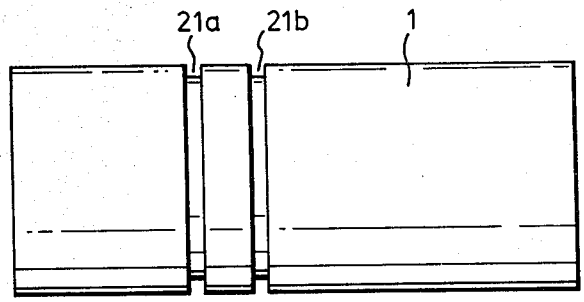
FIG. 3 is a side elevational view of an alternative form of the grooved roller.

As a further alternative, shown in FIG. 3, more than one peripheral recess or groove may be provided in the roller 1 to allow adjustment of the axial position of the tube 20 relative to the rollers by fixing to the cross-member 8 at different axial locations.

The mouth of the yarn guide tube 20 terminates in the common plane of the roller axes which is at a small spacing, of the order of 1 mm, above the line of yarn formation, but again the actual position of termination can be adjusted to ensure the minimum separation from the yarn formation line. In this way the undesirable transient variability of the position where the strand enters the yarn formation line and joins with the staple fibres is reduced to a minimum.

As the yarn guide tube 20 is secured to the cross-member 8, it is lifted by movement of the cradle 7 about the pivot pin 18, so that both ends of the yarn guide tube are accessible for threading.

The grooves 21 are of sufficiently small dimensions that they do not materially detract from the spinning performance.

In contrast to the previous publications mentioned above, the surface of the roller 1 is formed of a metallic material, although other materials are possible.

In an alternative arrangement (not shown) cooperating peripheral recesses or grooves are provided in both rollers so that the depth of each is correspondingly reduced. This arrangement may, for example, be used in an alternative embodiment wherein both of the rollers are perforated as opposed to the illustrated embodiment wherein the imperforate roller is particularly convenient to receive the full depth of the required groove.

Figure 2:
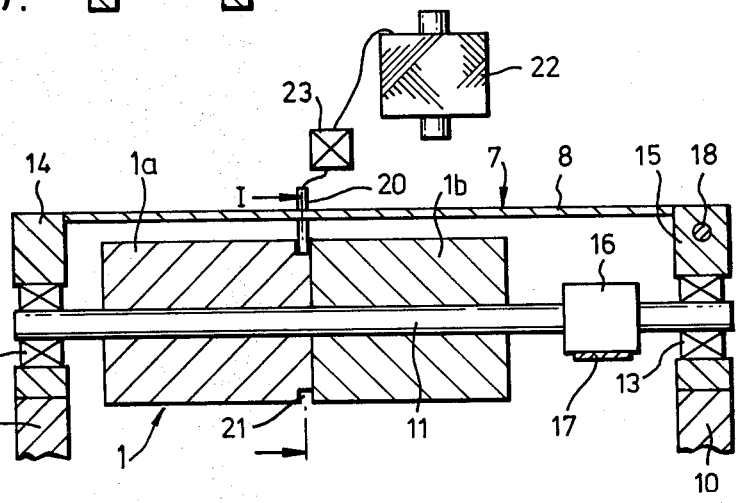
FIG. 2 is a cross-sectional view, taken along the line II—II of FIG. 1.

FIG. 2 shows that the recess is provided between two separate axially successive coaxial bodies 1*a* and 1*b* which together form the roller 1. The bodies 1*a* and 1*b* could instead be spaced apart by a distance at least as great as the diameter of the tube 20.

The strand guide tube 20 could alternatively project upwardly into the nip from below the rollers 1,2 and the fibre feed duct could then guide the airborne fibres down onto the rollers from above.

We claim:

1. In apparatus for forming a yarn including a component of staple fibres and a component formed by a continuous strand, comprising:

(a) first and second rollers each rotatable about a respective axis of rotation and arranged such that the surface of each of the rollers cooperates with a surface of the other to form an elongate yarn formation zone at a line of closest approach of the surfaces;

(b) means for feeding the staple fibres to the elongate yarn formation zone;

(c) means for guiding the continuous strand to the elongate yarn formation zone; and (d) means for rotating each of the surfaces about a respective axis to twist the fibres and strand to form a yarn, the improvement comprising:

(e) means defining a peripheral recess in one of said surfaces lying in a plane radial to said respective axis of rotation of the surface for receiving said strand guide means.

2. Apparatus according to claim 1, wherein the strand guide means comprises a tube.

3. Apparatus according to claim 2, wherein said tube has a portion adjacent the line of closest approach, and wherein said tube portion lies in a plane at right-angles to the line of closest approach.

4. Apparatus according to claim 3, wherein said portion of the tube is straight.

5. Apparatus according to claim 1, wherein the strand guide means extends to the line of closest approach.

6. Apparatus according to claim 1, wherein the strand guide means is formed of a ceramic material.

7. Apparatus according to claim 1, wherein said first roller has the groove therein and is an imperforate roller, and said second roller is a perforated drum; and further including means for communicating suction to the interior of said drum.

8. Apparatus according to claim 1, wherein said first roller comprises first and second axially successive coaxial bodies and said groove is defined therebetween.

9. Apparatus according to claim 1, wherein said first roller has means defining a plurality of said grooves therealong at axially spaced locations.

* * * * *